US007163042B2

(12) United States Patent
Li

(10) Patent No.: US 7,163,042 B2
(45) Date of Patent: Jan. 16, 2007

(54) ADJUSTABLE DUSTPROOF SUNSHADE ARRANGEMENT

(76) Inventor: Wanda Ying Li, 121 E. Alton, Santa Ana, CA (US) 92707

( * ) Notice: Subject to any disclaimer, the term of this patent is extended or adjusted under 35 U.S.C. 154(b) by 151 days.

(21) Appl. No.: 10/865,384

(22) Filed: Jun. 8, 2004

(65) Prior Publication Data

US 2005/0092445 A1 May 5, 2005

(30) Foreign Application Priority Data

Oct. 30, 2003 (CN) ..... 2003 2 01149631

(51) Int. Cl.
*E04F 10/06* (2006.01)

(52) U.S. Cl. ..... 160/22; 160/70

(58) Field of Classification Search ..... 160/22, 160/66, 70, 79; 135/88.11
See application file for complete search history.

(56) References Cited

U.S. PATENT DOCUMENTS 3,782,443 A * 1/1974 Clauss et al. ..... 160/22
4,479,526 A * 10/1984 Rinaldi et al. ..... 160/22
4,566,516 A * 1/1986 Lohausen ..... 160/22
4,590,642 A * 5/1986 Hesener ..... 16/241
4,784,204 A * 11/1988 Lohausen ..... 160/22
5,029,363 A * 7/1991 Hesener ..... 16/241
5,139,068 A * 8/1992 Lohausen ..... 160/66
5,273,095 A * 12/1993 Lukos ..... 160/70
6,024,152 A * 2/2000 Rosenich ..... 160/22
6,739,371 B1 * 5/2004 Mukai ..... 160/22
2001/0027846 A1 * 10/2001 Osinga ..... 160/70

* cited by examiner

*Primary Examiner*—David Purol
(74) *Attorney, Agent, or Firm*—Raymond Y. Chan; David & Raymond Patent Firm

(57) ABSTRACT

An adjustable dustproof sunshade arrangement includes a wall base, a supporting arm and an adjustable joint including a supporting seat mounted at the wall base and an adjustment member pivotally connected with an inner end of the supporting arm in a longitudinal direction, wherein the adjustment member is pivotally connected to the supporting seat in a transverse direction such that the supporting arm is adapted to longitudinally and transversely shift with respect to the wall base. A fabric shelter has an inner edge attached to the wall base and an outer edge extended to attach to an outer end of the supporting arm to define a shading area under the fabric shelter, wherein the supporting arm is adapted to longitudinally and transversely shift with respect to the wall base to selectively adjust a position of the fabric shelter so as to maximize the shading area thereunder.

15 Claims, 6 Drawing Sheets

ADJUSTABLE DUSTPROOF SUNSHADE ARRANGEMENT

BACKGROUND OF THE PRESENT INVENTION

1. Field of Invention

The present invention relates to a sunshade awning, more particularly, relates to an adjustable dustproof sunshade arrangement which is capable of vertically and laterally adjusting the fabric shelter for maximize the shading area thereof.

2. Description of Related Arts

An awning is a kind of sunshade device installed to a building, such as an apartment or a villa, for shielding the building from direct exposure to strong sunlight. There exist a variety of retractable awnings available on the market nowadays. However, these kinds of retractable awnings are failed to provide displacement functions. In other words, these kinds of awning can not be adjusted laterally and vertically, thus, they merely provide limited shielding zone instead of an extended shielding range in accordance with the sun's position from dawn to twilight. Moreover, such sunshade awnings are supposedly to be exposed outside regardless of the climatic variedness. So, awnings are susceptible to dusts and smudges. Unfortunately, those dusts and smudges are difficult to be removed.

SUMMARY OF THE PRESENT INVENTION

A main object of the present invention is to provide an adjustable dustproof sunshade arrangement which comprises a retractable awning adapted to vertically and laterally adjust for maximize the shading area thereof.

Another object of the present invention is to provide an adjustable dustproof sunshade arrangement, wherein the fabric shelter is adapted to be retracted to receive in a shelter holder so as to prevent the fabric shelter from getting dust.

Accordingly, in order to accomplish the above objects, the present invention provides an adjustable dustproof sunshade arrangement, comprising:

a wall base adapted for longitudinally mounting on a wall surface;

at least a supporting arm having an inner end and an outer end;

an adjustable joint comprising a supporting seat mounted at the wall base and an adjustment member pivotally connected with the inner end of the supporting arm in a longitudinal direction, wherein the adjustment member is pivotally connected to the supporting seat in a transverse direction such that the supporting arm is adapted to longitudinally and transversely shift with respect to the wall base; and a fabric shelter having an inner edge attached to the wall base and an outer edge extended to attach to the outer end of the supporting arm to define a shading area under the fabric shelter, wherein the supporting arm is adapted to longitudinally and transversely shift with respect to the wall base to selectively adjust a position of the fabric shelter so as to maximize the shading area thereunder.

These and other objectives, features, and advantages of the present invention will become apparent from the following detailed description, the accompanying drawings and the appended claims.

DETAILED DESCRIPTION OF THE PREFERRED EMBODIMENT

Figure 1:
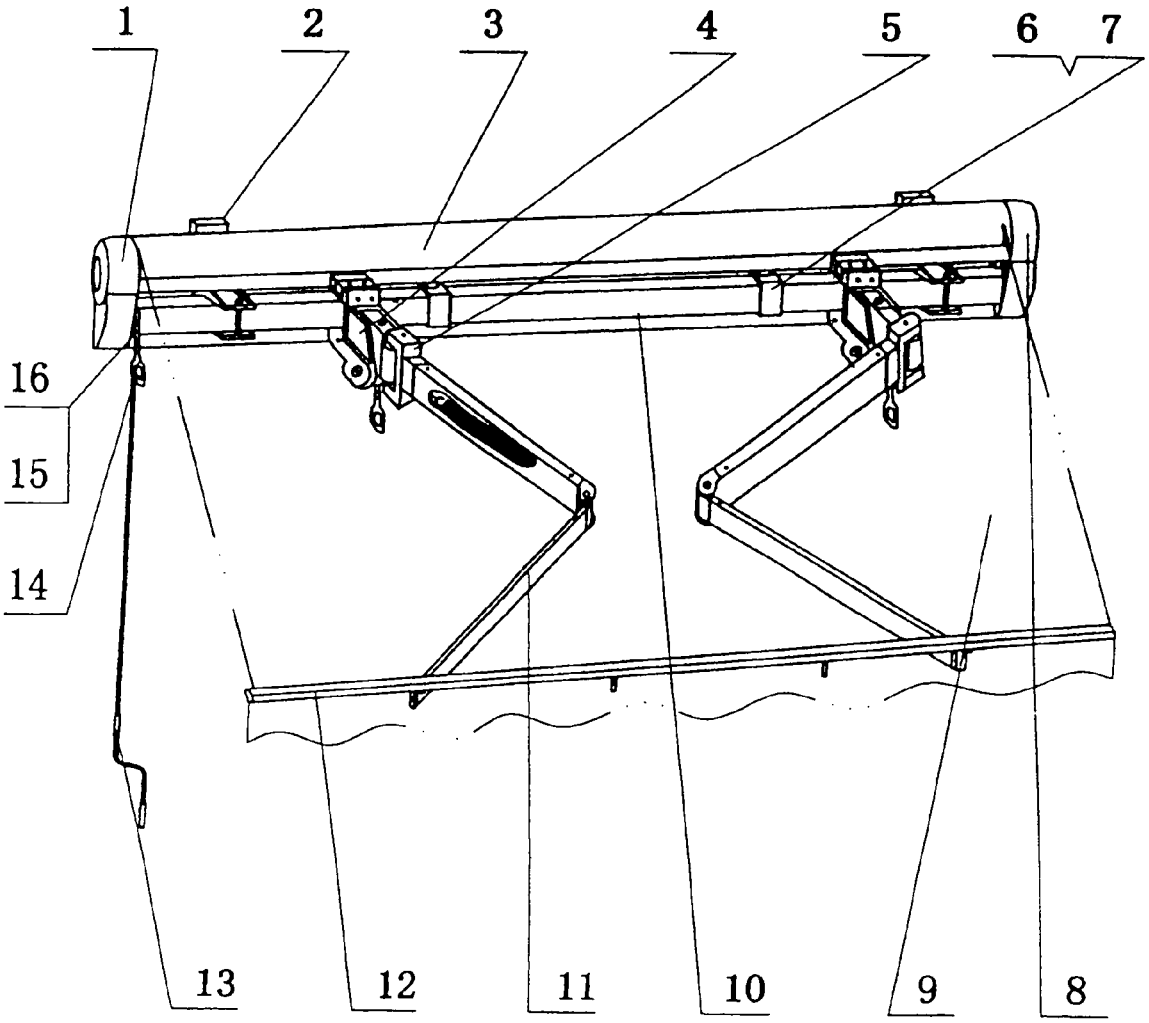
FIG. 1 is a perspective view of the adjustable dustproof sunshade arrangement according to a preferred embodiment of the present invention.

Referring to the FIG. 1, the adjustable dustproof awing according to the first preferred embodiment of the present invention is illustrated. The adjustable dustproof sunshade arrangement comprises a first side cover 1, a wall base 2, an adjustable joint 4, an arm coupler 5, a fabric shelter seat 6, a shelter bolt 7, a second side cover 8, a fabric shelter 9, a rear support 10, at least a supporting arm 11, a front support 12, a cranking handle 13, and a speed reducer 14.

The wall base 2 is adapted for longitudinally mounting on a wall. The supporting arm 11 has an inner end and an outer end. The arm coupler 5 is coupling at the inner end of the supporting arm 11. The adjustable joint 4 is mounted at the wall base 2 to pivotally connect with the arm coupler 5. The fabric shelter 9 has inner edge attached to the wall base 2 and an outer edge extended to attach to the outer end of the supporting arm 11 to define a shading area under the fabric shelter 9, wherein the supporting arm 11 is adapted to longitudinally and transversely shift with respect to the wall base 2 to selectively adjust a position of the fabric shelter 9 with respect to the wall surface so as to maximize the shading area thereunder.

Figure 4:
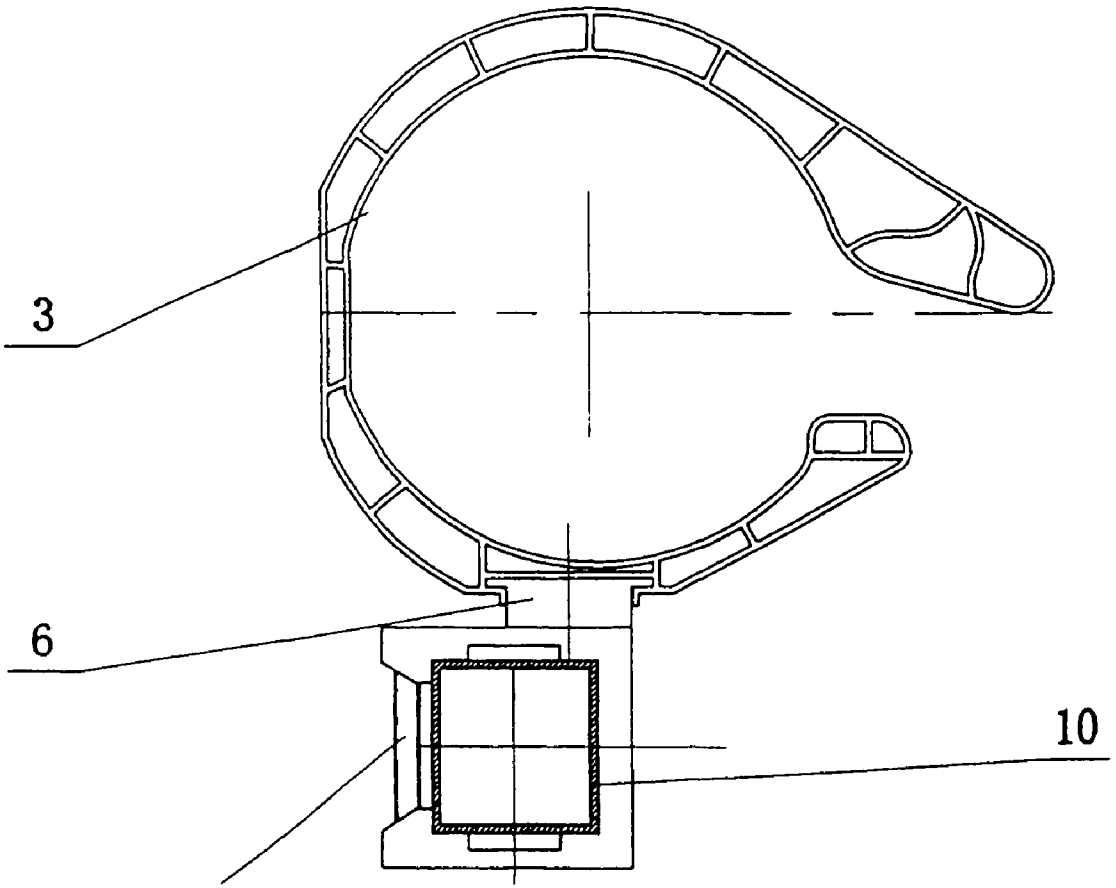
FIG. 4 is a section view of the shelter holder of the adjustable dustproof sunshade arrangement according to the preferred embodiment of the present invention, illustrating the shelter holder being supported on the adjustable joint.
Figure 5:
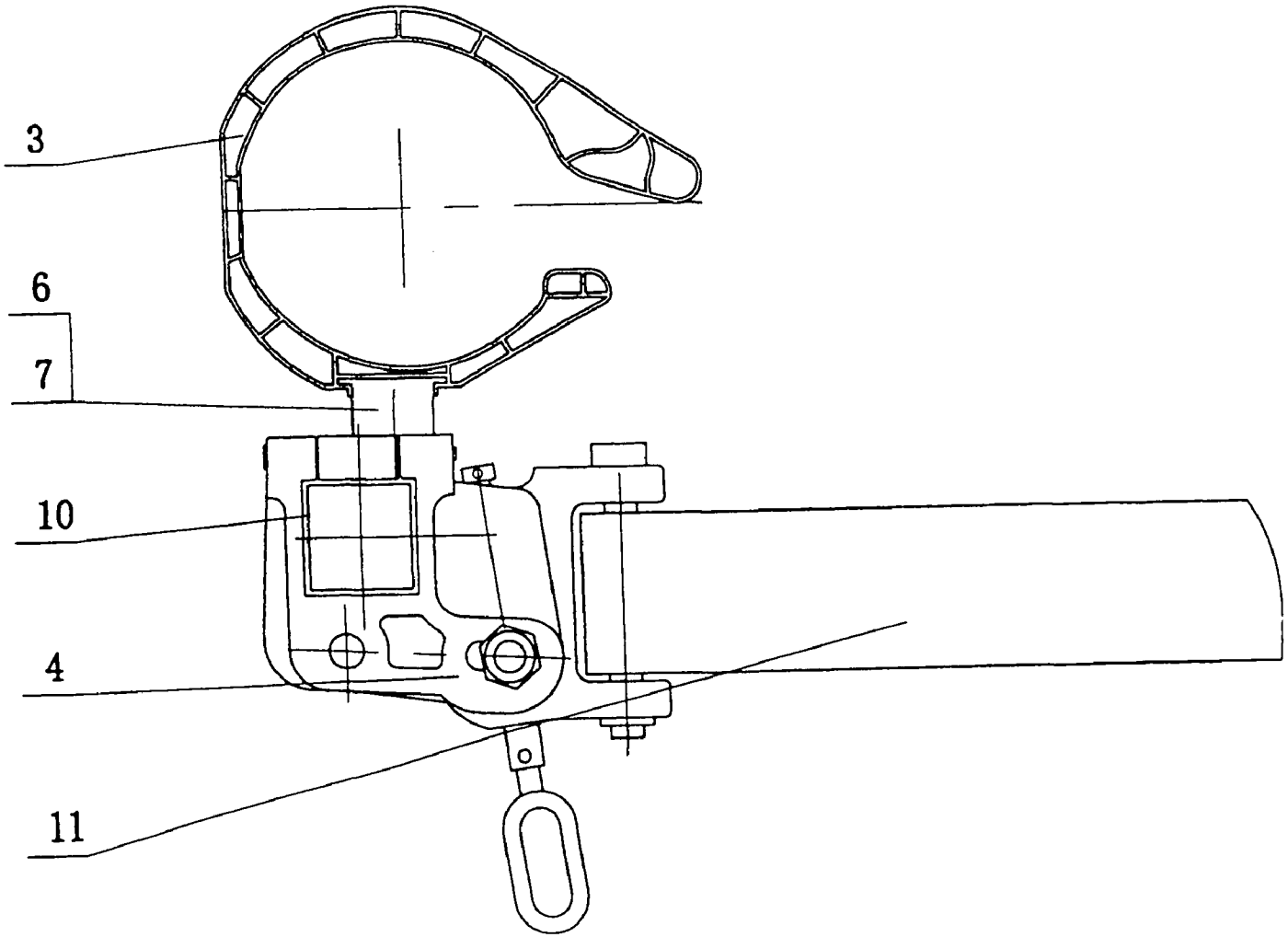
FIG. 5 is a sectional view of the shelter holder of the adjustable dustproof sunshade arrangement according to the preferred embodiment of the present invention, showing the shelter holder being connected with the rear support.
Figure 6:
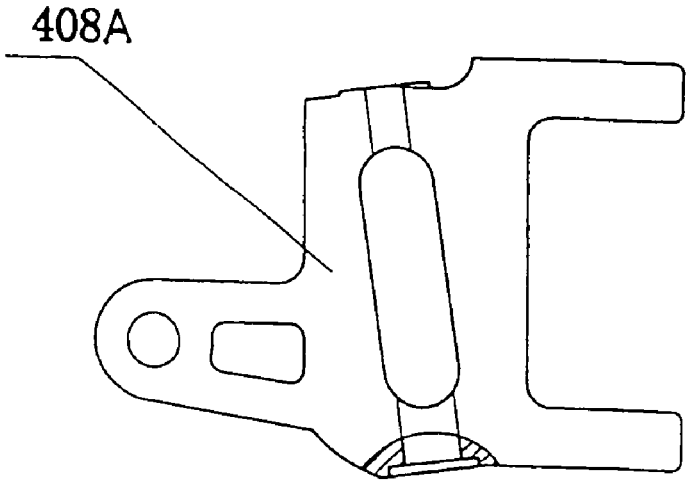
FIG. 6 is a side view of an alternative mode of the adjustment member of the adjustable dustproof sunshade arrangement according to the above preferred embodiment of the present invention.

As shown in FIGS. 5 and 6, the wall base 2 comprises a shelter holder 3, a retractable roller 15 and a roller holder 16 to hold the retractable roller 15 in the shelter holder 3 via the fabric shelter seat 6, wherein the inner edge of the fabric shelter 9 is attached to the retractable roller 15 such that when the fabric shelter 9 is reeled on the retractable roller 15, the fabric shelter 9 is received in the shelter holder 3. As shown in FIG. 4, the rear support 10 is adapted for longitudinally mounted on the wall surface to longitudinally support the shelter holder 3 and the front support 12 is longitudinally mounted at the outer end of the supporting arm 11 in a detachably attaching manner to support the outer edge of the fabric shelter 9. Therefore, the outer edge of the fabric shelter 9 is adapted to pull out from the shelter holder 3 to the outer end of the supporting arm 11 via the front support 12 so as to substantially stretch out the fabric shelter 9 to define the shading area thereunder. In other words, the front support 12 is mounted along the outer edge of the fabric shelter 9 wherein the front support 12 is detachably mounted to the outer end of the supporting arm 11. Preferably, the fabric shelter 9, which is made of PVC material, is embodied as a tarpaulin having waterproof ability. The side covers 1, 8 are respectively affixed on the two side ends of the roller holder 3. In other words, the fabric shelter 9 is rolled up within the roller holder 3 to prevent the fabric shelter 9 from getting dust.

According to the preferred embodiment of the present invention, the adjustable joint 4 comprises a rear end affixed to the rear support 10 and a front end pivotally connected to the arm coupler 5. It is noted that there are different modes of supporting arms 11 available. To comply with different modes of supporting arms 11, two types of supporting arm coupler 5 are applied in the present invention. Accordingly, there are two types of adjustable joint 4 provided for pivotally connecting the arm coupler 5 embodied in the present invention as shown in FIGS. 2 and 3.

Figure 2:
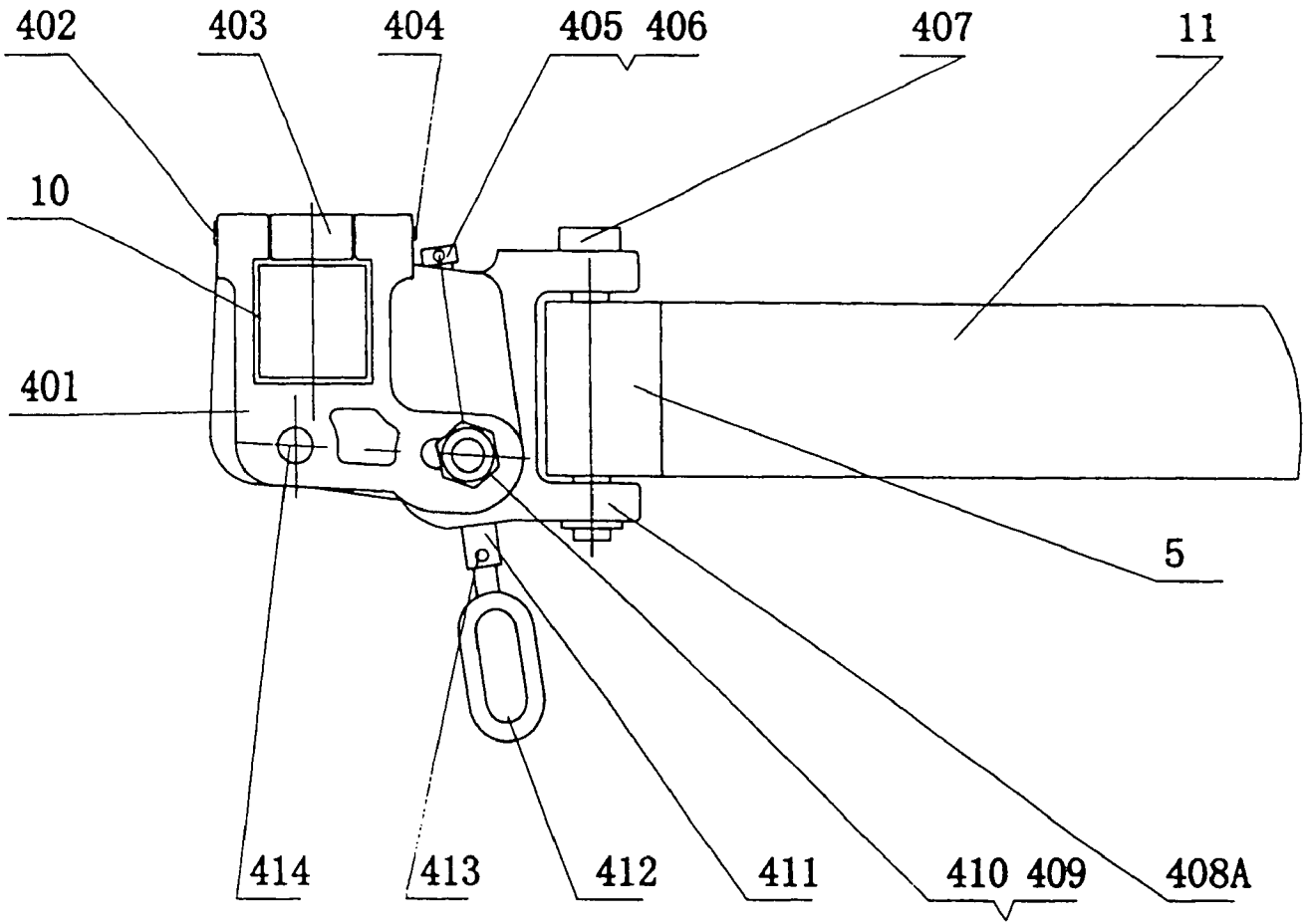
FIG. 2 is a side view of an alternative mode of the adjustable joint of the adjustable dustproof sunshade arrangement according to the above preferred embodiment of the present invention.

Referring to the FIG. 2, the adjustable joint 4 comprises a supporting seat 401, a supporting seat bolt 402, an adjusting plate 403, a supporting seat nut 404, a retaining nut 405, a retaining pin 406, a coupler pin 407, an adjustment member 408, a slider shaft 409, a blocking nut 410, an adjusting arm 411, a hand cranking member 412, a hand cranking bolt 413, and a supporting shaft 414. The supporting seat 401 is mounted to the rear support 10 of the wall base 2 through the adjusting plate 403 in a bolt-nut connecting manner. The adjustment member 408 is pivotally connected with the inner end of the supporting arm 11 via the arm coupler 5 in a longitudinal direction, wherein the adjustment member 408 is pivotally connected to the supporting seat 401 in a transverse direction such that the supporting arm 11 is adapted to longitudinally and transversely shift with respect to the wall base 2.

Figure 3:
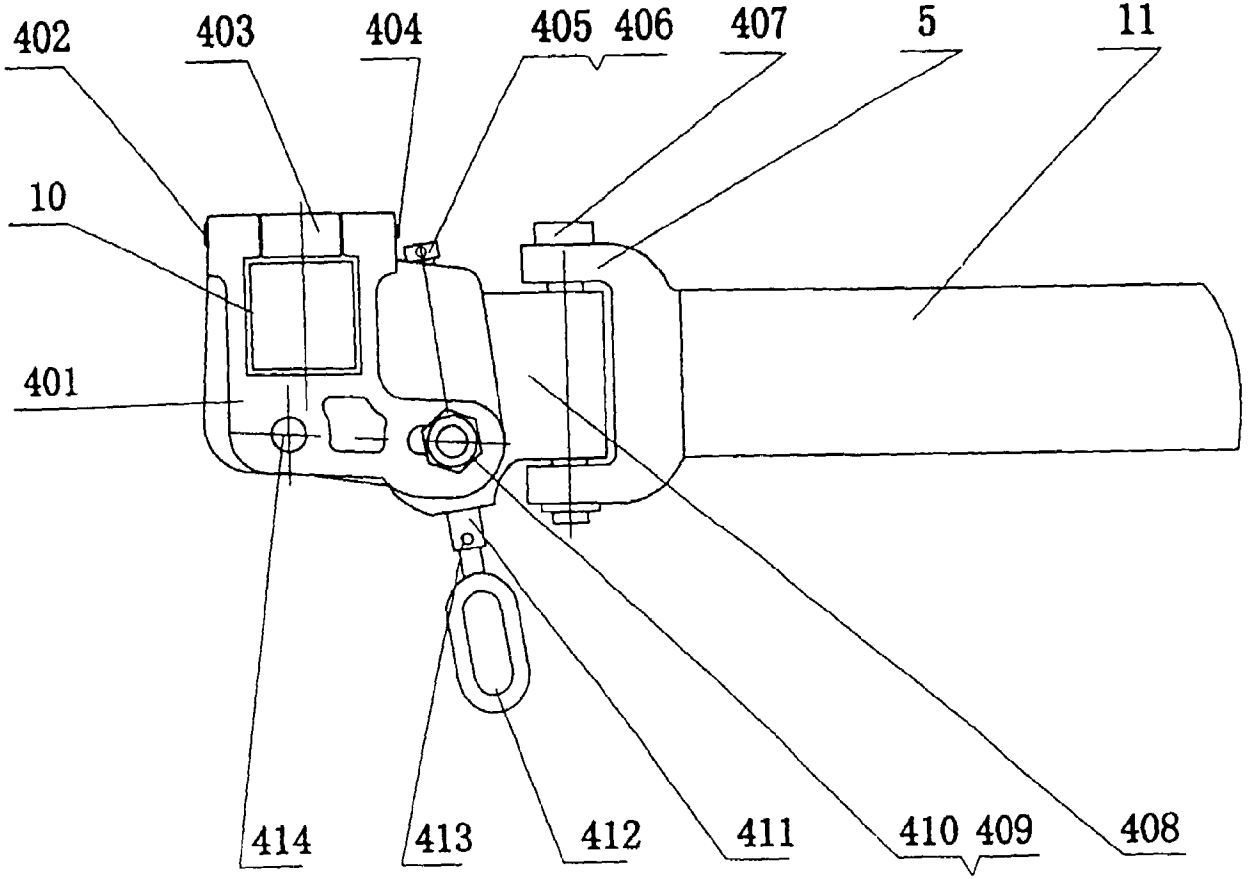
FIG. 3 is a side view of the adjustable joint of the adjustable dustproof sunshade arrangement according to the above preferred embodiment of the present invention.
Figure 7:
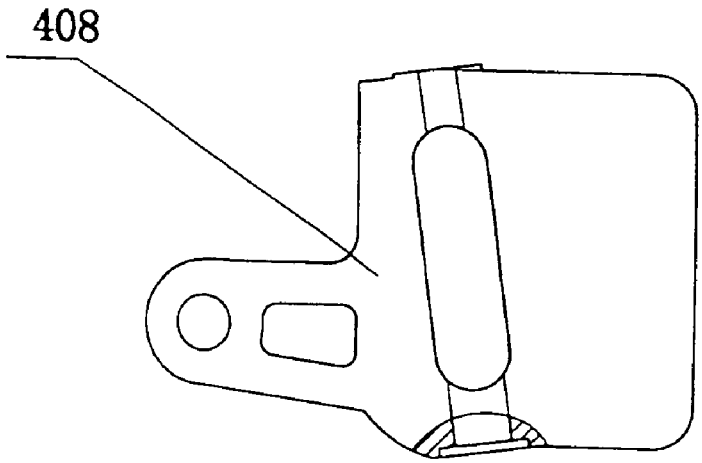
FIG. 7 is a side view of the adjustment member of the adjustable dustproof sunshade arrangement according to the above preferred embodiment of the present invention.

As shown in FIGS. 3 and 7, the adjustment member 408 has an elongated through slot and an end portion pivotally connected to the supporting seat 401 via the supporting shaft 414, wherein the slider shaft 409 passes through the elongated through slot to slidably mount the adjustment member 408 to the supporting seat 401 such that the adjustment member 408 is pivotally moved via the supporting shaft 414 to drive the slider shaft 409 to slide along the elongated through slot so as to limit the pivotally transverse movement of the adjustment member 408 with respect to the supporting seat 401. In addition, the adjusting arm 411 is rotatably mounted to the adjustment member 408 through the elongated through slot to control the sliding movement of the slider shaft 409 so as to selectively adjust the sliding position of the adjustment member 408 with respect to the supporting seat 401.

In other words, the adjustment member 408 has the elongated through slot in an inclined manner which the slider shaft 409 is capable of being inserted, wherein the slider shaft 409 slides along the elongated through slot when the adjustment member 408 is pivotally moved about the end portion thereof with respect to the supporting seat 401. It is seen from the FIG. 2 that the slider shaft 409 is inserted into the supporting seat 401 through a lateral slot defined on the supporting seat 401 and the adjustment member 408 through said elongated through slot, and two ends of the slider shaft 409 are provided with blocking nut 410 for securely mounting the adjustment member 408 on the supporting seat 401. What is more, the slider shaft 409 further has a threaded hole defined on the middle portion of the slider shaft 409 with a size of M10. On the other hand, the adjusting arm 411 has an end connected to the hand cranking member 412, and another end continuously extended penetrating through the adjustment member 408 as well as the threaded hole of the slider shaft 409 to be mounted on the supporting seat 401 by the retaining bolt 405 and retaining pin 406. It is worth to mention that the middle portion of the adjusting arm 411 is externally threaded with a size of M10 for correspondingly mating with the threaded hole defined on the slider shaft 409. In other words, the adjusting arm 411 is engaged with the slider shaft 409 in a screw-thread manner.

As a result, by rotating the adjusting arm 411 through the hand cranking member 412, the adjusting arm 411 is capable of displacing with respect to the slider shaft 409. This is to say that the rotation of the adjusting arm 411 is capable of driving the slider shaft 409 to move in a vertical manner. Since the slider shaft 409 is inserted into the elongated through slot of the adjustment member 408, and the adjustment member 408 is pivotally mounted on the supporting shaft 414 of the supporting seat 401, the vertical movement of the slider shaft 409 will drive the adjustment member 408 displacing with respect to the supporting shaft 414 in a radial moveable manner. Furthermore, the supporting arm 11 is pivotally connected to the adjustment member 408 through the supporting arm coupler 5, so that the supporting arms 11 are capable of moving vertically with respect to the rear support 10 as a consequence of the rotating adjusting arm 411.

According to the preferred embodiment of the present invention, the adjustment member 408 has two different modes for mating with the structure of the arm coupler 5 as shown in FIGS. 6 and 7.

As shown in FIGS. 3 and 7, the arm coupler 5, having a U-shaped cross section, is pivotally connected to the adjustment member 408 via the coupler pin 407 such that the supporting arm 11 is adapted to pivotally shift with respect to the adjustment member 408 in a longitudinal direction.

Referring to the FIG. 6, an alternative mode of the adjustment member 408A according to the preferred embodiment is illustrated. The adjustment member 408A has a U-shaped connecting portion pivotally connecting the inner end of the supporting arm 11 via the coupler pin 407 as shown in FIGS. 2 and 6. Because the supporting arm 11 is pivotally connected to the adjustment member 408A through the arm coupler 5 via the coupler pin 407, the supporting arm 11 is capable of laterally moving with respect to the adjustment member 408A of the adjustable joint 4. It is noted that the structure of the adjustable joint 4 of both modes are quite similar. The difference is that the structures of adjustment member 408, 408A of two modes are different for articulating arm coupler 5 of different types.

Therefore, the adjustable dustproof sunshade arrangement according to the present invention is capable of being vertically and laterally adjustable, plus being dustproof due to the installation of the tarpaulin.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An adjustable dustproof sunshade arrangement, comprising:

a wall base adapted for mounting on a wall surface;

a shelter holder attaching to said wall base for longitudinally mounting on said wall surface;

a fabric shelter retractably reeled in a roll manner, wherein said fabric shelter has an inner edge attached to said shelter holder and an outer edge arranged when said fabric shelter is reeled up, said fabric shelter is received in said shelter holder, and when said outer edge of said fabric shelter is pulled out from said shelter holder, said fabric shelter forms a shading area thereunder;

an adjustable joint, comprising:

a supporting seat mounted at said shelter holder;

an adjustment member having an elongated through slot and an end portion pivotally connected to said supporting seat in a transverse direction; and a slider shaft, which passes through said elongated through slot, slidably mounting said adjustment member to said supporting seat, wherein said adjustment member is pivotally moved to drive said slider shaft to slide along said elongated through slot to limit a pivotally transverse movement of said adjustment member along said elongated through slot with respect to said supporting seat; and at least a supporting arm having an inner end pivotally connecting to said adjustment member in a longitudinal direction and an outer end mounting to said outer edge of said fabric shelter to retain said fabric shelter in an extending position, wherein said supporting arm is longitudinally and transversely shifted with respect to said wall base to selectively adjust a position of said fabric shelter with respect to said wall surface so as to maximize said shading area thereunder.

2. The adjustable dustproof sunshade arrangement, as recited in claim 1, wherein said elongated through slot is extended in an inclined manner that said slider shaft slides along said elongated through slot when said adjustment member is pivotally moved about said end portion thereof with respect to said supporting seat.

3. The adjustable dustproof sunshade arrangement, as recited in claim 1, wherein said adjustable joint further comprises an adjusting arm rotatably mounted to said adjustment member through said elongated through slot to control a sliding movement of said slider shaft so as to selectively adjust a sliding position of said adjustment member with respect to said supporting seat.

4. The adjustable dustproof sunshade arrangement, as recited in claim 2, wherein said adjustable joint further comprises an adjusting arm rotatably mounted to said adjustment member through said elongated through slot to control a sliding movement of said slider shaft so as to selectively adjust a sliding position of said adjustment member with respect to said supporting seat.

5. The adjustable dustproof sunshade arrangement, as recited in claim 1, further comprising a front support which is mounted along said outer edge of said fabric shelter and is detachably attached to said outer end of said supporting arm such that when said front support is detached from said fabric shelter, said fabric shelter is retracted into said shelter holder, and when said front support is pulled away from said fabric shelter, said outer edge of said fabric shelter is pulled to substantially stretch out said fabric shelter is to form said shading area thereunder.

6. The adjustable dustproof sunshade arrangement, as recited in claim 2, further comprising a front support which is mounted along said outer edge of said fabric shelter and is detachably attached to said outer end of said supporting arm such that when said front support is detached from said fabric shelter, said fabric shelter is retracted into said shelter holder, and when said front support is pulled away from said fabric shelter, said outer edge of said fabric shelter is pulled to substantially stretch out said fabric shelter is to form said shading area thereunder.

7. The adjustable dustproof sunshade arrangement, as recited in claim 4, further comprising a front support which is mounted along said outer edge of said fabric shelter and is detachably attached to said outer end of said supporting arm such that when said front support is detached from said fabric shelter, said fabric shelter is retracted into said shelter holder, and when said front support is pulled away from said fabric shelter, said outer edge of said fabric shelter is pulled to substantially stretch out said fabric shelter is to form said shading area thereunder.

8. The adjustable dustproof sunshade arrangement, as recited in claim 4, wherein said fabric shelter is made of PVC having waterproof ability.

9. The adjustable dustproof sunshade arrangement, as recited in claim 7, wherein said fabric shelter is made of PVC having waterproof ability.

10. The adjustable dustproof sunshade arrangement, as recited in claim 4, further comprising an arm coupler, having a U-shaped cross section, coupling with said inner end of said supporting arm, wherein said arm coupler is pivotally connected to said adjustment member such that said supporting arm is adapted to pivotally shift with respect to said adjustment member in a longitudinal direction.

11. The adjustable dustproof sunshade arrangement, as recited in claim 7, further comprising an arm coupler, having a U-shaped cross section, coupling with said inner end of said supporting arm, wherein said arm coupler is pivotally connected to said adjustment member such that said supporting arm is adapted to pivotally shift with respect to said adjustment member in a longitudinal direction.

12. The adjustable dustproof sunshade arrangement, as recited in claim 9, further comprising an arm coupler, having a U-shaped cross section, coupling with said inner end of said supporting arm, wherein said arm coupler is pivotally connected to said adjustment member such that said supporting arm is adapted to pivotally shift with respect to said adjustment member in a longitudinal direction.

13. The adjustable dustproof sunshade arrangement, as recited in claim 4, wherein said adjustment member has a U-shaped connecting portion pivotally connecting said inner end of said supporting arm such that said supporting arm is adapted to pivotally shift with respect to said adjustment member in a longitudinal direction.

14. The adjustable dustproof sunshade arrangement, as recited in claim 7, wherein said adjustment member has a U-shaped connecting portion pivotally connecting said inner end of said supporting arm such that said supporting arm is adapted to pivotally shift with respect to said adjustment member in a longitudinal direction.

15. The adjustable dustproof sunshade arrangement, as recited in claim 9, wherein said adjustment member has a U-shaped connecting portion pivotally connecting said inner end of said supporting arm such that said supporting arm is adapted to pivotally shift with respect to said adjustment member in a longitudinal direction.

* * * * *